United States Patent [19]

Ziebold

[11] Patent Number: 4,470,449

[45] Date of Patent: Sep. 11, 1984

[54] ECONOMIZER ARRANGEMENT

[75] Inventor: Steven A. Ziebold, Waterloo, Ill.

[73] Assignee: Monsanto Company, St. Louis, Mo.

[21] Appl. No.: 364,595

[22] Filed: Apr. 2, 1982

[51] Int. Cl.[3] ..... F28F 27/02; F28F 19/00; C01B 17/98; C22B 26/20

[52] U.S. Cl. ..... 165/1; 165/103; 165/110; 165/134 DP; 165/143; 422/160; 422/201; 423/522

[58] Field of Search ..... 423/522, 531, 533, 539; 422/160, 161, 201; 165/134 DP, 143, 144, 103, 174, 110, 1

[56] References Cited

U.S. PATENT DOCUMENTS

| | | | |
|---|---|---|---|
| 3,194,214 | 7/1965 | Frendberg | 165/134 DP |
| 4,318,366 | 3/1982 | Tompkins | 165/134 DP |

FOREIGN PATENT DOCUMENTS

| | | | |
|---|---|---|---|
| 28848 | 5/1981 | European Pat. Off. | 423/522 |
| 154311 | 4/1982 | German Democratic Rep. | 165/134 DP |
| 54-119392 | 9/1979 | Japan | 423/522 |
| 151590 | 11/1979 | Japan | 423/522 |
| 54-152691 | 12/1979 | Japan | 423/522 |
| 745627 | 2/1956 | United Kingdom | 423/522 |

OTHER PUBLICATIONS

Browder, T. J., Improvements in Sulfuric Acid Process, C.E.P., Mar. 1977, pp. 70–76.

*Primary Examiner*—Gary P. Straub
*Attorney, Agent, or Firm*—Lawrence L. Limpus

[57] ABSTRACT

A shell and tube type of economizer is divided into first, second and third sections. Gas flow through the economizer flows sequentially through the first, second and third sections. The liquid first flows through the second section and then through the third and first sections. The second section serves as a preheater to increase the heat recovered from the gas stream.

4 Claims, 4 Drawing Figures

ECONOMIZER ARRANGEMENT

BACKGROUND OF THE INVENTION

This invention relates to a novel piping configuration for an economizer in a sulfuric acid plant. This invention also relates to a method of operation of the economizer to increase the heat which may be removed from the sulfuric acid process. More particularly, this invention relates to a novel piping configuration and a method of operation for an economizer which provides for the removal of more heat from the sulfuric acid process while reducing the corrosion caused by the condensation of sulfuric acid within the economizer.

DESCRIPTION OF THE PRIOR ART

One process for the manufacture of sulfuric acid starts with the oxidation or burning of sulfur to form sulfur dioxide. The sulfur dioxide is then catalytically oxidized in a converter to sulfur trioxide which is removed from the gas stream in one or more absorption stages to form sulfuric acid. The oxidation of sulfur dioxide to sulfur trioxide is an exothermic reaction. In the past the design of sulfuric acid plants has concentrated on using the heat that is created by the process to heat the gas streams to the ignition temperature required for the conversion of sulfur dioxide to sulfur trioxide. Heat is generated in excess of that required for this function and much of it was lost to cooling water circulated through cooling towers. Therefore, economizers are used to provide hot water such as heating boiler feed water or a heated process stream for use outside the boundaries of the sulfuric acid plant.

An economizer is defined as being an assemblage of water-filled pipes or fintubes placed in the path of escaping flue gases and used to heat feed water. Internal corrosion is avoided by the use of properly conditioned feed water and external corrosion by holding the flue gas temperature high enough to prevent the condensation and formation of liquid sulfuric acid. In a sulfuric acid plant an economizer is a heat exchanger most often constructed of the shell and tube type of configuration, which is used to remove heat from the sulfuric acid process and to provide that heat to a process external to the sulfuric acid plant such as the heating of boiler feed water.

In a typical economizer in a sulfur burning sulfuric acid plant, the sulfuric acid dew point controls the amount of energy than can be recovered through the use of an economizer. The acid dew point, that temperature at which the gas condenses to form liquid sulfuric acid, is determined primarily by the hydrocarbon content of the sulfur and the efficiency of the drying tower. The dew point is a critical factor in the use of the economizers as the condensation of acid on the fintubes causes corrosion and sulfate buildup between the fins of the tubes within the economizer. This shortens the life of the economizer and also reduces the recoverable energy since the heat transfer coefficient on the gas side is lowered. To prevent this condensation, it is imperative that the tubes within the economizer be maintained at a temperature greater than the acid dew point. Since liquid flow through the economizer and gas flow through the economizer are often countercurrent, that is they flow in opposite directions through the economizer, the coolest portion of the economizer is the tubes located where the cool liquid enters the economizer for this is also the location of the cool exit gas. To prevent condensation of acid on the tubes at the gas exit point, it has been necessary in the past to maintain the gas temperature at a temperature far above the acid dew point; thus, great quantities of energy are lost.

SUMMARY OF THE INVENTION

It is an object of this invention to provide an economizer having a novel piping configuration.

It is a further object of this invention to provide a method of operation of the economizer to increase the heat which may be removed from the sulfuric acid process while preventing the corrosion caused by the condensation of sulfuric acid within the economizer.

These and other objects are obtained through a novel piping configuration which allows the liquid to be preheated to prevent the tube wall temperatures within the economizer from being reduced to a temperature lower than the dew point of the sulfuric acid-containing gas. When a single economizer is used, the economizer is divided into first, second and third sections with the second section intermediate the first and third sections. The process gas flows sequentially through the first, second and third sections while the liquid flows sequentially through the second, third and first sections. The first section is the hottest in that it includes the entrance for the hot process gas and completes the heat transfer between the hot gas and the liquid before the liquid exits from the economizer. The third and final section of the economizer is the coolest section. In this final section the gas is cooled to its lowest temperature while imparting heat to the liquid which is entering the economizer. It is in this section that the greatest concern arises for the gas will be cooled to a temperature equal to or very close to the dew point of the gas. If the temperature of the liquid entering this section of the economizer is too low, condensation will occur on the tubes. This condensation is sulfuric acid which will severely corrode the tubes of the economizer and impede heat transfer. A second section of the economizer is placed between the first and third sections to prevent the liquid entering the third section from being so cool as to draw the temperature of the tubes within the third section below the dew point of the gas. Section two is used as a preheater for the liquid. The water entering the third section of the economizer first passes through the second section to be preheated; thus, the gas exit temperature may be reduced below the temperatures required by the prior art since the warmed liquid will keep the economizer tubes from reaching a temperature below the acid dew point. To aid the preheater section of the economizer, some of the gas entering the first section may be allowed to bypass the first section to provide additional heat in the preheat or second section of the economizer. This allows the economizer to be designed to achieve the maximum heat recovery from the gas while keeping the economizer tubes at a temperature above the acid dew point. It may be easily seen that a greater heat recovery will mean the warming of more of a process liquid or boiler feed water without the requirement of higher gas flows.

During operation of the economizer of this invention, the temperature of the liquid is primarily controlled by the size of each of the three economizer sections relative to one another. The temperature, for example, of the liquid entering the third or final section of the economizer, and therefore the temperature of the economizer tubes at the gas exit point, is determined by the size of the second or preheat section of the economizer.

It is recognized that the acid dew point in a flowing gas stream in a sulfuric acid plant is not a constant temperature. Therefore, this invention includes a gas bypass around the first section of the economizer. If the dew point were to rise, gas flow through the bypass increases the heat available at the second or preheat section of the economizer to raise the temperature of liquid passing through this section of the economizer above the normal operating temperature. This raises the temperature of the liquid entering the third section of the economizer since it is the same liquid and consequently raises the temperature of the tubes at the gas exit to a temperature above the higher acid dew point. The economizer is sized to operate with no gas flowing through the bypass for it must be recognized that while the gas bypass is in use, the temperature of the exit gas is above the designed minimum temperature with a resulting reduction in the energy recovered by the economizer. Gas side bypassing around the entire economizer has been proposed in the past; however, it has been discounted as it would normally result in overcooling the gas passing through the economizer and thus dropping the tube wall temperature below the dew point of the gas creating condensation of acid and causing higher corrosion of the tubes. Gas bypassing to an intermediate economizer section does not have this shortcoming. Moreover, the ability to control the tube wall temperature at the gas exit of the economizer is greatly improved. When the design and method of operation of this invention are used in conjunction with a dew point meter, the sulfuric acid plant can control the gas cooling so that maximum energy recovery is nearly always realized.

DESCRIPTION OF THE PREFERRED EMBODIMENTS

Figure 1:
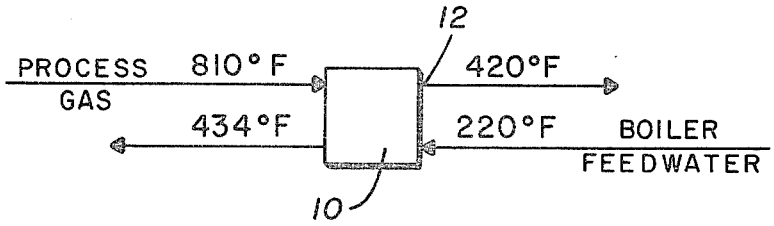
FIG. 1 is a schematic of an economizer as used in the prior art.

For the purposes of the following description of this invention, it will be assumed that the economizer is being used to heat boiler feed water for use outside the sulfuric acid plant. It is noted that the economizer could as easily be used to heat another process. Each of these uses would be equal as the important factor is that excess heat generated by the process of manufacturing sulfuric acid is being profitably used rather than being lost or wasted in a cooling tower. Turning now to FIG. 1, a schematic of an economizer 10 as used in the prior art is shown. Hot process gas from the sulfuric acid plant enters the economizer and is cooled during passage through the economizer. A boiler feed water flow countercurrent to the gas flow is shown also. Countercurrent flow means that the gas and the liquid flowing through the economizer flow in opposite directions. This is in contrast to concurrent flow in which the gas and liquid flow in the same direction. In this discussion, the liquid will flow through the interior of the fintubes in the economizer and the gas will flow through the shell of the economizer and pass around the fintubes. For the purposes of FIG. 1, the acid dew point of the gas was chosen to be equal to 260° F. It is imperative that the tube wall temperature at the gas exit 12 be maintained at a temperature greater than the acid dew point. Otherwise the acid condenses on the tube surfaces and the liquid sulfuric acid creates excessive corrosion and sulfate buildup with impeded heat transfer and early failure of the tubes.

In FIG. 1 the process gas is shown entering the economizer 10 at a temperature of 810° F. and is shown exiting from the economizer at a cooler temperature of 420° F. The boiler feed water is shown entering the economizer at a temperature of 220° F. and exiting from the economizer at a temperature of 434° F. after being heated by the heat transferred from the gas. This economizer is being used to cool 131,000 pounds per hour of the process gas and to heat 40,000 pounds per hour of the boiler feed water with an energy transfer of 12.2 million btu's per hour. Not shown in FIG. 1 is the temperature of the tube walls at the gas exit 12, coolest portion of the economizer. It is possible to measure the tube wall temperature in a field installation; however, for purposes of this discussion that temperature will be approximated. It is known that the coefficient of heat transfer for the liquid, the boiler feed water, is much greater than the heat transfer coefficient for the gas. Therefore, the tube wall temperature will be closer to the temperature of the entering liquid than to the temperature of the exiting gas. This temperature will be approximated as being equal to the temperature of the boiler feed water plus one-fifth of the temperature differential between the entering boiler feed water and the exiting process gas. This approximation is show as equation 1:

$$T_t = T_w + 1/5(T_g - T_w) \quad (1)$$

where $T_t$ = temperature of the tube wall, $T_w$ = temperature of the entering liquid, and $T_g$ = temperature of the exiting gas.

Thus, substituting the temperatures shown in FIG. 1 into equation (1), it is shown:

$$T_t = 220° \text{ F.} + 1/5(420° \text{ F.} = 220° \text{ F.})$$

$$T_t = 260° \text{ F.}$$

This tube wall temperature of 260° F. is equal to the acid dew point in this example of 260° F., thus, there will be no condensation of the acid in the gas stream. However, should the boiler feed water fall below 220° F. or should the gas be cooled to a temperature lower than 420° F., the tube wall temperature will fall below the acid dew point and liquid acid will condense on the tubes within the economizer. To prevent this condensation, an economizer in the past would be designed to prevent the gas from being cooled to this low a temperature so that a safety factor could be maintained to prevent minor fluctuations in temperature from causing condensation in the economizer.

Figure 2:
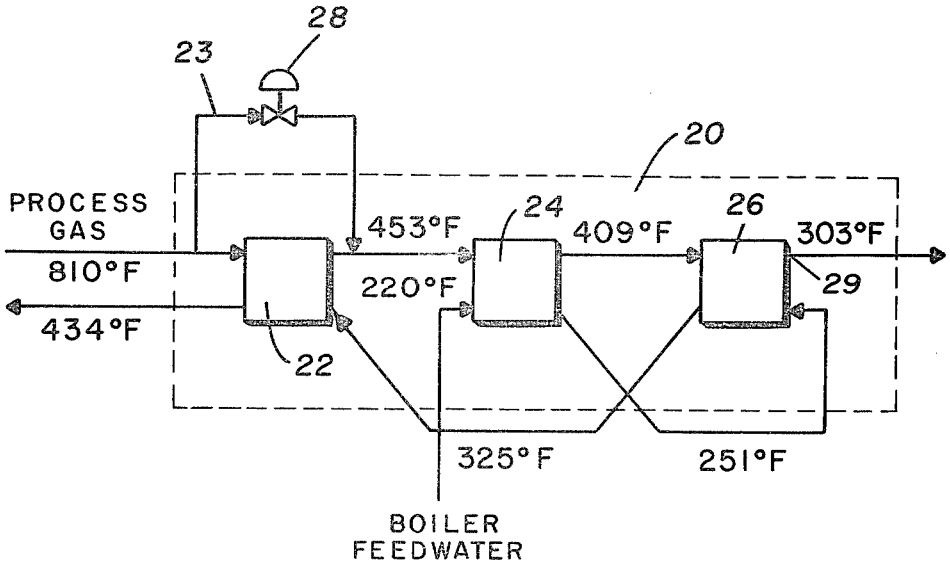
FIGS. 2 and 3 are schematics of the economizer of this invention.

Turning now to FIG. 2, an economizer of the preferred design of this invention is shown. Economizer 20 is shown divided into three sections, a first section 22 is used for energy control, a second section 24 is used to preheat the liquid entering the economizer 20 and a third section 26 is used as an energy trimmer to complete removal of the maximum amount of energy from the process gas which passes through economizer 20. A bypass 23 including bypass valve 28 is shown as a possible route for gas flow around first section 22 of the economizer 20. The process conditions shown for economizer 20 in FIG. 2 are the same as those shown for economizer 10, the prior art economizer, in FIG. 1. The process gas enters the economizer 20 at a temperature of 810° F. and the boiler feed water enters the economizer 20 at a temperature of 220° F. As in FIG. 1, 131,000 pounds per hour of the process gas flow through the economizer and 44,000 pounds per hour of boiler feed water are heated. The boiler feed water exits the economizer at a temperature of 434° F., just as in FIG. 1. The advantage of the design of this invention over the prior art is shown by the gas temperature at the gas exit 29 of economizer 20 which is 303° F. rather than the 420° F. shown at the gas exit 12 in FIG. 1 and by the percentage of the boiler feed water which is flashed to steam at the exit of the economizer 20. In the economizer 20 of FIG. 2, 18.6 percent of the boiler feed water is flashed or converted to stream whereas only 11 percent was converted to steam in the economizer 10 of FIG. 1. This is indicative of a much greater recovery of the heat from the process gas passing through the economizer. The acid dew point in the process gas is again 260° F.

Following the process gas through the economizer 20 with the bypass valve 28 in the closed position, the process gas enters the first section 22. First section 22 is also called the energy control section because the greatest amount of energy is transferred from the process gas to the boiler feed water and because through the use of the bypass valve 28 the temperatures throughout the economizer 20 may be controlled. After passing through the first section 22, the gas enters the second section 24. The second section 24 is used to preheat the boiler feed water to prevent the tube wall temperature at the gas exit 29 in the third section 26 from falling below the dew point and to enable the temperature of the gas to be reduced to a minimum. After passing through the second section 24, the gas enters the third section 26 which is used as an energy trimmer. In section 26 the final heat transfer from the gas to the liquid takes place to complete the removal of a maximum quantity of energy from the gas. The temperature of the gas entering each section of the economizer 20 and of the gas at the gas exit 29 of the economizer 20 is also shown in FIG. 2. The process gas enters the first section 22 at a temperature of 810° F. It enters second section 24 at a temperature of 453° F. and third section 26 at a temperature of 409° F. The temperature of the gas at the gas exit 29 is 303° F. which is substantially below the 420° F. at the gas exit 12 of economizer 10 in FIG. 1.

Turning now to the liquid flow through the economizer 20, boiler feed water is shown entering the second section 24 where it is preheated from a temperature of 220° F. to a temperature of 251° F. Following passage through the second section 24, the boiler feed water passes sequentially through the third section 26 and the first section 22 of economizer 20. In each section the boiler feed water is heated further. The temperature of the boiler feed water following passage through third section 26 is 325° F. and following passage through first section 22, where the heated liquid exits from the economizer 20, the temperature is 434° F. with 18.6 percent of the boiler feed water flashed or vaporized into steam.

The consideration of the acid dew point and the tube wall temperature at the gas exit 29 from the economizer 20 is as important with the economizer piping arrangement of this invention as it is with the economizers of the prior art. The approximation of tube wall temperature which was discussed in conjunction with FIG. 1 is as useful in this situation as it was in the prior discussion; therefore, equation (1) will be used to consider the tube wall temperature at the gas exit 29 and at the entrance to and exit from the second section 24. Looking first at the second section 24, where the boiler feed water is preheated, the gas and liquid are in concurrent flow; thus, the coldest liquid temperature is met with the hottest gas temperature. The tube wall temperature at the entrance to second section 24 is approximated by equation (1) to be equal to:

$$T_t = 220° \text{ F.} + 1/5(453° \text{ F.} - 220° \text{ F.})$$

$$T_t = 266° \text{ F.}$$

which is a temperature above the acid dew point of 260° F.; thus, there will be no condensation of sulfuric acid at this portion of the tubes. At the exit from second section 24 the tube wall temperature is:

$$T_t = 251° \text{ F.} + 1/5(409° \text{ F.} - 251° \text{ F.})$$

$$T_t = 282° \text{ F.}$$

Again, this temperature is above the acid dew point. It has been shown that the boiler feed water may be preheated in second section 24 of economizer 20 without reducing the tube wall temperature to a temperature which might cause condensation of sulfuric acid from the process gas and increased corrosion of the economizer tubes in this section. The process gas and the boiler feed water passing through third section 26 of economizer 20 are shown in countercurrent flow. Therefore, the coldest liquid temperature and the coldest gas temperature occur at the same portion of the economizer tubes, the gas exit 29. Again, using equation (1) to calculate the approximate tube wall temperature, it is shown that:

$$T_t = 251° \text{ F.} + 1/5(303° \text{ F.} - 251° \text{ F.})$$

$$T_t = 261° \text{ F.}$$

The tube wall temperature at the gas exit 29 from the economizer 20 is greater than the acid dew point. Thus, there will be no condensation of the sulfuric acid from the process gas and, as a result, excess corrosion and sulfate buildup caused by the condensing liquid acid will be prevented.

The energy transferred from the process gas to the boiler feed water in the economizer 20 is 15.9 million btu's per hour. Compared to the 12.2 million btu's per hour recovered in the economizer 10 of the prior art, the economizer 20 of this invention is capable of recovering 30 percent more energy. While doing this, the economizer 20 maintains the tube wall temperature at the gas exit 29 at a point above the dew point of the sulfuric acid in the process gas.

The use of the gas bypass 23 allows the energy recovery in the economizer 20 to be adjusted to achieve maximum energy recovery while adjusting the temperatures to prevent the gas exit tube wall temperature from falling below the dew point of the sulfuric acid in the process gas. This can be done while the plant is running. During normal operation the economizer 20 is designed to operate with the bypass valve 28 fully closed and no gas flow through the bypass 23. When operated in this manner, the economizer 20 is designed for the tube wall temperature at the gas exit 29 to be equal to or slightly above the normal dew point. This is accomplished by the design and relative sizing of the three sections of the economizer 20. However, it is recognized that the acid dew point in the gas stream is not a constant temperature; therefore, the gas bypass 23 around the first section 22 of the economizer 20 is included. If the dew point were to fall, no change would be made in the operation of the economizer 20 as the tube wall temperature at the gas exit 29 would remain above the lower dew point. On the other hand, if the dew point were to rise, gas flow through the bypass 23 would be initiated by partially opening the bypass valve 28. Gas flow through the bypass 23 increases the gas temperature at second section 24 and as a result raises the temperature of the boiler feed water passing through second section 24 to a temperature above the normal operating temperature. This raises the temperature of the liquid entering the third section 26 of the economizer 20 and consequentially raises the temperature of the tubes at the gas exit 29 to a temperature above the higher acid dew point. Similarly, the higher gas temperatures at the entrance to second section 24 will mean a higher gas temperature at the exit to second section 24 and also a higher gas temperature at the gas exit 29 to aid in raising the temperature of the tubes at the gas exit 29 to a temperature above the acid dew point. It is recognized that while the gas bypass 23 is in use as a result of the higher acid dew point, the temperature of the exit gas is above the designed minimum temperature with a resulting reduction in the energy recovered by the economizer 20. When the acid dew point is again lowered to the designed temperature, the bypass valve 28 may be closed and the economizer 20 will return to its operation for maximum energy recovery.

Figure 3:
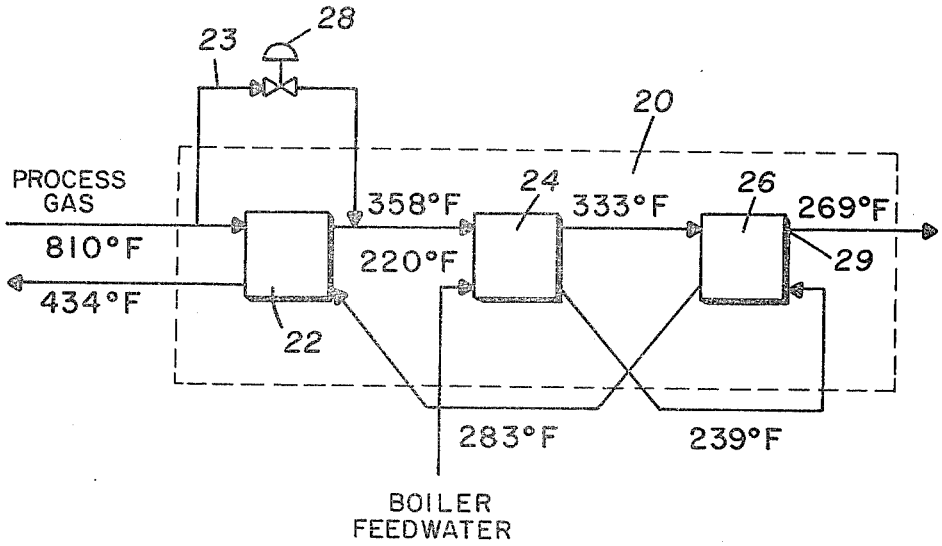

FIG. 3 shows the same economizer 20 as was shown in FIG. 2. However, the design conditions are changed in FIG. 3; thus, the designed size of the first section 22, second section 24, and third section 26 of the economizer 20 will be changed. Table I below shows the effect of opening the bypass valve 28. As the bypass valve 28 is opened, the effect on the gas temperature at the gas exit 29 and on the temperatures at other points within the economizer 20 are shown.

TABLE I

| | ECONOMIZER TEMPERATURES (°F.) | | | |
|---|---|---|---|---|
| | SECOND SECTION | | THIRD SECTION | |
| Gas Bypass (%) | Inlet Gas | Exit Water | Exit Gas | Exit Tubewall |
| 0 | 359 | 239 | 269 | 245 |
| 10 | 423 | 247 | 292 | 256 |
| 20 | 481 | 255 | 313 | 266 |
| 30 | 534 | 262 | 332 | 276 |
| 40 | 582 | 268 | 349 | 284 |
| 50 | 626 | 274 | 366 | 292 |

TABLE I-continued

| | ECONOMIZER TEMPERATURES (°F.) | | | |
|---|---|---|---|---|
| | SECOND SECTION | | THIRD SECTION | |
| Gas Bypass (%) | Inlet Gas | Exit Water | Exit Gas | Exit Tubewall |
| 60 | 668 | 280 | 381 | 300 |

Figure 4:
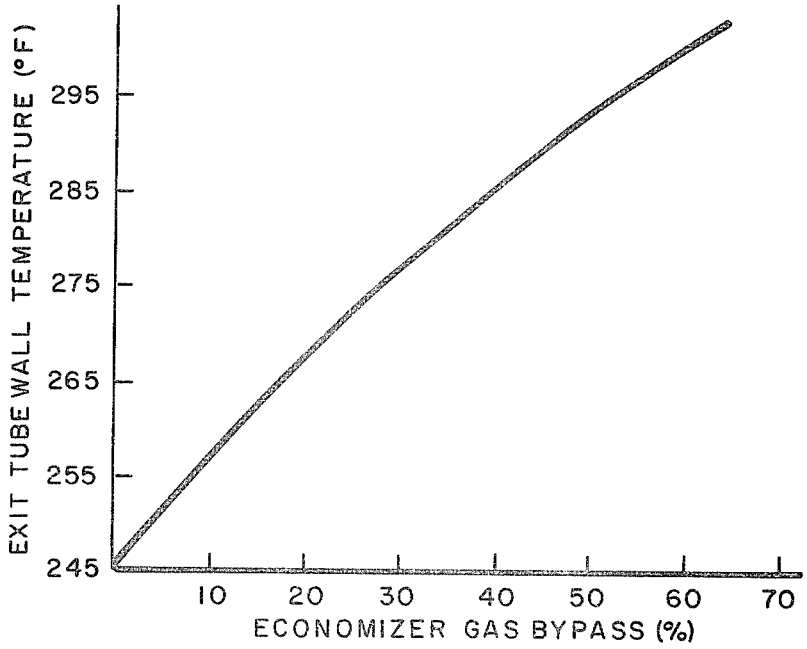
FIG. 4 is a graph of the relationship between the percentage of the gas flow bypassing the first section of the economizer and the temperature of the tube wall at the gas exit.

FIG. 4 is a graphical representation of the information shown in Table I, the relationship between the percentage of the gas flow bypassing the first section 22 of the economizer 20 and the temperature of the tube wall at the gas exit 29. As may easily be seen, operation of the bypass valve 28 from fully closed to a position allowing 60% of the process gas to bypass the first section 22 causes an increase in the temperature of the tube walls at the gas exit 29 from 245° F. to 300° F.

From the above, it is easily seen that the use of this invention increases the heat that may be recovered from a process while preventing increased corrosion within the equipment. The conditions shown above in describing the invention are to be considered as illustrative only and the following claims define the scope of this invention.

I claim:

1. An apparatus for removing heat from a gas stream to heat a liquid stream comprising:

an economizer having a shell and tube construction having first, second and third sections, said second section being intermediate said first and third sections, said gas stream flowing sequentially through said first, second and third sections and said liquid stream flowing sequentially through said second, third and first sections, said gas stream and said liquid stream being in concurrent flow in said second section and in countercurrent flow in said first and third sections.

2. The apparatus of claim 1 further including a gas bypass around said first section to pass a portion of said gas stream to said second section, said gas bypass having a gas bypass valve for controlling the quantity of said gas stream flowing through said gas bypass.

3. A method of operating an economizer having a shell and tube configuration for removing heat from a gas stream containing condensable gases to heat a liquid stream comprising:

constructing said economizer in first, second and third sections, said second section being intermediate said first and third sections;

passing said heated gas stream sequentially through said first, second and third sections of said economizer;

passing said liquid stream through said second section in concurrent flow with said gas stream to preheat said liquid stream; and passing said liquid stream sequentially through said third and first sections in countercurrent flow with said gas stream while preventing condensation of said condensable gases in said gas stream.

4. The method of claim 3 further including bypassing a portion of said gas stream around said first section of said economizer and passing said bypassed portion of said gas stream to said second section to provide increased quantities of heat at said second section to increase the preheat of said liquid stream.

* * * * *